US010940084B2

(12) United States Patent
Cimadamore

(10) Patent No.: US 10,940,084 B2
(45) Date of Patent: Mar. 9, 2021

(54) BATHTUB FOR SIMULATING BODY FLOTATION

(71) Applicant: HSIGN S.R.L., Monte Giberto FM (IT)

(72) Inventor: Anna Luisa Cimadamore, Fermo FM (IT)

(73) Assignee: HSIGN S.R.L., Monte Giberto FM (IT)

( * ) Notice: Subject to any disclaimer, the term of this patent is extended or adjusted under 35 U.S.C. 154(b) by 0 days.

(21) Appl. No.: 16/477,451

(22) PCT Filed: Jan. 12, 2017

(86) PCT No.: PCT/IB2017/050149

§ 371 (c)(1),
(2) Date: Jul. 11, 2019

(87) PCT Pub. No.: WO2018/130879

PCT Pub. Date: Jul. 19, 2018

(65) Prior Publication Data

US 2019/0380907 A1 Dec. 19, 2019

(51) Int. Cl.

| | |
|---|---|
| ***A61H 33/00*** | (2006.01) |
| ***A61H 37/00*** | (2006.01) |
| ***A61H 9/00*** | (2006.01) |

(52) U.S. Cl.

CPC ..... *A61H 33/0087* (2013.01); *A61H 33/6005* (2013.01); *A61H 37/005* (2013.01); *A61H 2009/0042* (2013.01); *A61H 2201/164* (2013.01); *A61H 2201/1604* (2013.01); *A61H 2201/1623* (2013.01); *A61H 2201/1633* (2013.01); *A61H 2201/1635* (2013.01)

(58) Field of Classification Search

CPC ..... A61H 33/0087; A61H 33/6005; A61H 2009/0042; A61H 2201/1604; A61H 2201/1623; A61H 2201/1635; A61H 2201/164; A47K 3/12; A61G 7/1003

USPC ..... 4/571.1, 573.1, 589, 621, 643, 506, 548

See application file for complete search history.

(56) References Cited

U.S. PATENT DOCUMENTS

| | | | | |
|---|---|---|---|---|
| 3,455,299 A | | 7/1969 | Gerow | |
| 4,085,738 A | * | 4/1978 | Kodera | A61B 5/00 600/557 |
| 4,726,080 A | * | 2/1988 | Henkin | A61H 33/027 4/492 |
| 5,010,605 A | | 4/1991 | Shiina | |

(Continued)

FOREIGN PATENT DOCUMENTS

| | | | |
|---|---|---|---|
| CA | 2508522 | A1 | 11/2006 |
| CH | 658373 | A5 | 11/1986 |

(Continued)

OTHER PUBLICATIONS

International Search Report and Written Opinion for International Application No. PCT/162017/050149, dated Sep. 14, 2017, European Patent Office, Netherlands, 13 pages.

*Primary Examiner* — Benjamin R Shaw
(74) *Attorney, Agent, or Firm* — Sterne, Kessler, Goldstein & Fox P.L.L.C.

(57) ABSTRACT

A bathtub (1) which comprises: —a main body (2) having side walls (22, 22*a*, 22*b*), at least one of which presents an inner surface provided with guide means (3); —supporting means (4) engaged with guide means (3) and configured for supporting at least a portion of user's body in order to allow, in use, simulating user flotation.

18 Claims, 3 Drawing Sheets

(56) References Cited

U.S. PATENT DOCUMENTS

| | | | | |
|---|---|---|---|---|
| 5,235,710 | A * | 8/1993 | Nagashima | A47C 23/065 4/547 |
| 2003/0212352 | A1* | 11/2003 | Kahn | A61H 35/002 601/98 |
| 2005/0273921 | A1* | 12/2005 | Mattson, Jr. | A61H 33/6073 4/541.1 |
| 2006/0265803 | A1* | 11/2006 | Brunelle | A61H 33/0087 4/541.1 |
| 2008/0086810 | A1* | 4/2008 | Le | A61H 33/6052 4/541.6 |
| 2008/0222788 | A1* | 9/2008 | Cunningham | A47K 3/02 4/538 |
| 2008/0250557 | A1* | 10/2008 | Mueller | E03C 1/0408 4/612 |
| 2009/0025138 | A1* | 1/2009 | Steggert | A47K 3/125 4/577.1 |
| 2009/0211021 | A1* | 8/2009 | Gabriele | E03C 1/021 4/678 |
| 2016/0052607 | A1* | 2/2016 | Sosnowski | A44B 11/2592 441/129 |

FOREIGN PATENT DOCUMENTS

| | | | |
|---|---|---|---|
| WO | WO-2014179899 | A2 | 11/2014 |
| WO | WO-2018130879 | A1 | 7/2018 |

* cited by examiner

BATHTUB FOR SIMULATING BODY FLOTATION

FIELD OF THE INVENTION

The present invention relates to a bathtub configured in order to simulate flotation of a user.

BACKGROUND OF THE INVENTION

Medical studies have shown that practicing the natural buoyancy or flotation of the body in hot water acts against stress and fatigue. Those who practice the natural flotation regularly regenerate quickly from injuries, relax deeply, improve mental balance and achieve good spiritual health with easiness.

Floating is a special way to swim and remain poised on the water. As said, water buoyancy (with the addition of large amounts of salts) counteracts the force of gravity of the body and creates a feeling of weightlessness. This condition produces deep relaxation both at physical and psychological level, and thereby triggers or accelerates regeneration processes on multiple levels. This results in increased mental efficiency, concentration and productivity.

For this reason, buoyancy is provided in various fields, from professional sports to pain therapy. In competitive sports buoyancy therapy results in two positive effects: on the one hand, the intense relaxation aids strengthening of muscles that only occurs in the regeneration phases; on the other hand, it allows rapid elimination of lactic acid which reduces the consequences of a high lactate accumulation such as fatigue, pain and muscle cramps.

Furthermore, floating on water is a gentle but effective remedy for common annoying pains, for acute disorders and also for chronic pain: the reduction of the load on the dorsal spine, muscles and joints not only loosens persistent contractions, but also soothes the pain caused by strains, sprains, herniated discs and joint pain. Deep relaxation contrasts also migraine and chronical pain, such as rheumatism. Even in case of severe trauma, such as broken bones or whiplash, it demonstrated that floating aids the healing process.

Flotation reduces load on cardiovascular system: blood pressure is lowered by virtue of dilation of blood vessels and heart rate slows down. Also the concentration of stress hormones such as cortisol and adrenaline is lowered, resulting in an increase of happiness hormones, endorphins: buoyancy makes the user feels happier.

Buoyancy stimulates very gently mental relaxation bringing to an intensity otherwise accessible only with a lot of discipline and a regular workout. Body weight seems reduced and mind indulges in new sensations: tranquility and intimacy of floating induced to creativity and self-awareness. Through synchronization of the two brain hemispheres the ability to concentrate in general increases, while at the same time more neuronal synapses are activated—essential conditions for creativity.

Disadvantageously, to practice natural flotation it is necessary to make the water assume the adequate density. Traditionally, this is achieved by adding large amounts of special salts to water, in order to make the weight of the displaced liquid be balanced by the weight of the body of the person who is plunging (according the Archimedes principle). This solution is neither easy nor economical.

Furthermore, not everyone has the opportunity to access special pools in SPA where water presents the necessary amount of salts to allow natural flotation, or to the sea where the desired water temperature cannot be adjusted.

Another problem lies in the fact that for some people, for example the elderly or people with mobility problems, get in the tank and practice float is not easy, and in some cases it is indeed impossible to do on its own.

SUMMARY OF THE INVENTION

The technical problem underlying the present invention is therefore that of overcoming the drawbacks mentioned above with reference to the state of the art. In particular, the invention is aimed at providing a device allowing to practice floating even in domestic or restricted environments, without the need for special equipments or for a dedicated salt composition into the water.

Such problem is solved by a bathtub according to claim 1.

Preferred features of the invention are recited in the dependent claims.

The bathtub according the present invention is configured to simulate or assist the natural flotation of a user, without adding salts or other coadjutants to water. For this purpose, the bathtub according to the present invention comprises supporting means apt to support the user's body at one or more portions or locations, in such a way to maintain the supported portion(s) or location(s) and the adjacent body district(s) spaced apart from an inner surface of the bathtub, so as to simulate floating of the body or of one or more portions thereof.

By using such a bathtub, the user is able to experiment the sensation and benefits associated with being partially or totally suspended in water without the exercise of any effort to maintain such condition. The body is actually held up mainly by the buoyancy of the water and the user lives the feeling of weightlessness, the muscles relaxing in water without having to contract to induce floatation.

Advantageously, according to preferred embodiments of the invention, the supporting means can be adjustable in position in order to adapt to the particular user anatomy or floating needs or preferences. In other words, the supporting means can be configured to be arranged in such a way to accommodate the body or the body portions which will float.

More advantageously, the bathtub according to the invention allows simplify entering in the bathtub and assuming the suspension position.

Preferably, the claimed bathtub has small size and can easily fit into any bathroom or environment, and has mechanisms (withdrawal and containment tubes) that allow anyone—even those who would need assistance to stay in the bathtub—to be able to float in full relaxation, even in plain water.

Furthermore, the bathtub can be furnished with hydromassage means to carry out massage by water jets, allowing the user to get in combination benefits of floatation and water jet massage.

Particularly, the use of the invention is indicated for patients which need massage therapies and physiotherapy treatments providing partial or total flotation, as it allows to perform the prescribed exercises even at home.

BRIEF DESCRIPTION OF THE DRAWINGS

Reference will be made to the figures of the annexed drawings, wherein.

The above-mentioned figures are to be meant exclusively by way of example and not for limitative purposes.

DETAILED DESCRIPTION OF PREFERRED EMBODIMENTS OF THE INVENTION

Figure 1:
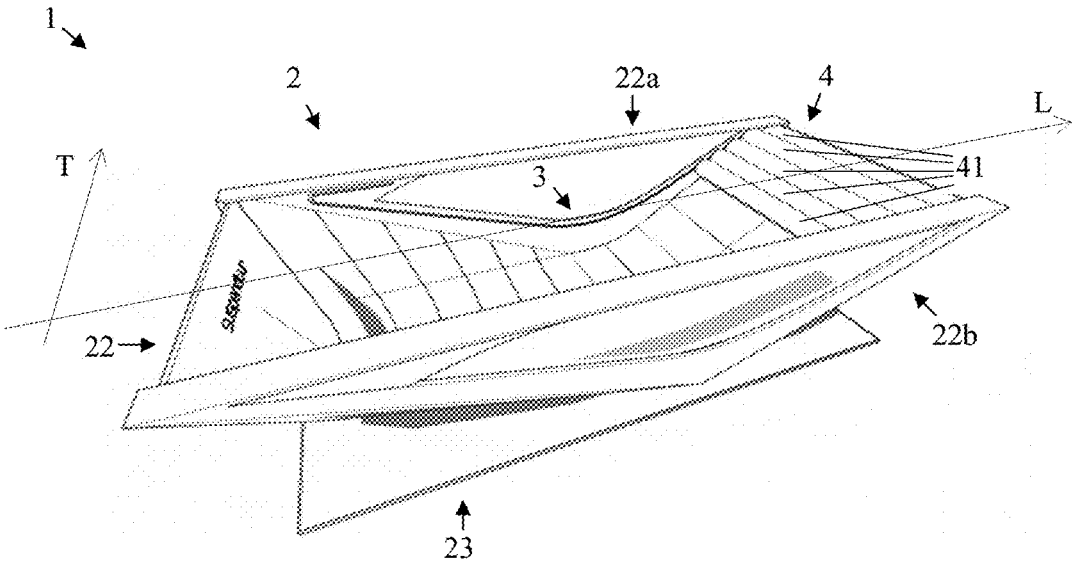
FIG. 1 and FIG. 2 show a perspective view and a partially-transparent side view, respectively, of a preferred embodiment of a bathtub according to the present invention, wherein supporting means are arranged in a configuration apt to support the head of a user.
Figure 3:
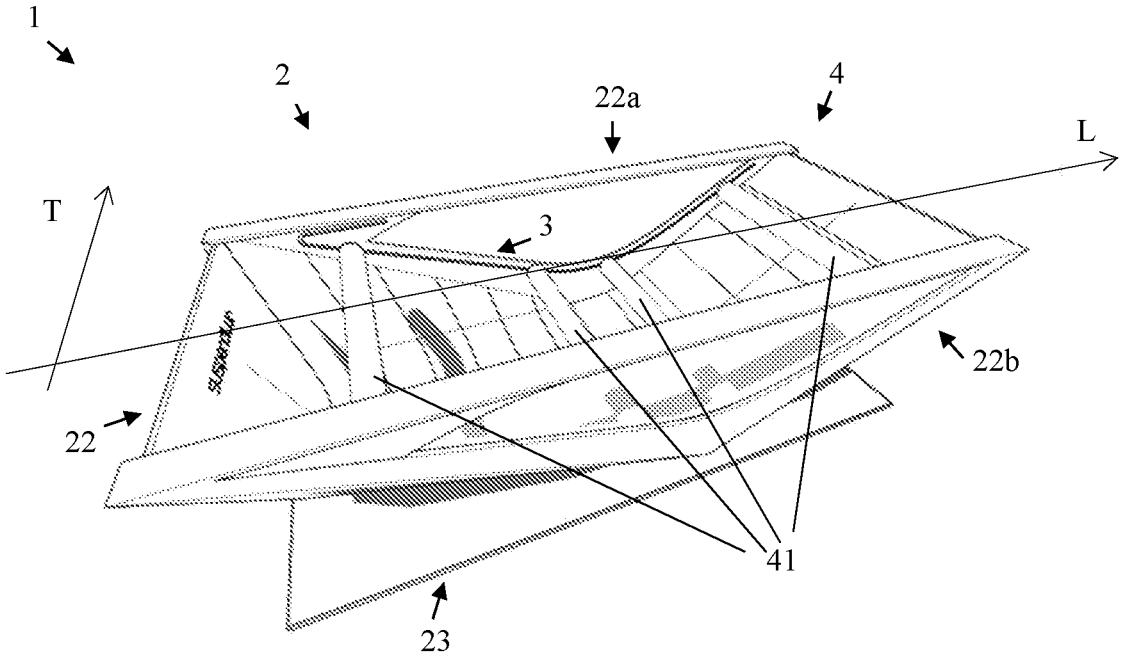
FIG. 3 and FIG. 4 show a perspective view and a partially-transparent side view, respectively, of the bathtub according to the embodiment of FIG. 1, in a first floating simulation configuration.

With reference to FIGS. 1 and 3, a bathtub according to a preferred embodiment of the present invention is globally denoted by 1.

As will be appreciated in the following, the bathtub 1 is configured for simulating or assist flotation of a user.

The bathtub 1 may comprise means for connection to a water supply network, alternatively it can be used as a tank to be filled from other sources.

The bathtub 1 comprises a main body 2 configured to contain a floating fluid, typically water, and to accommodate a user's body. Main body 2 extends according to a longitudinal direction L, corresponding to human body length or height, and to a transversal direction T, orthogonal to direction L, as shown in FIG. 1 by way of example. According to a preferred embodiment of the invention, the longitudinal direction L shown in FIG. 1 can coincide with an axis of longitudinal symmetry of the bathtub 1.

The main body 2 could have any kind of shape, for example with polygonal or circular plan. According to the preferred embodiment of the invention herein described, the main body 2 comprises a bottom wall 22 and two opposite side walls 22*a*, 22*b*. Preferably, at least one of said walls is transparent.

The bottom wall 22 can comprise an upper surface with a substantially "U" shape development, with longitudinal end portions raised with respect to an intermediate portion. According to this configuration, if the intermediate portion has a supporting surface on the floor too small to assure a correct and safe installation of the bathtub, a base or platform 23 apt to be rested on the floor for supporting the bathtub 1 can be provided.

The bathtub 1 according to the present invention comprises supporting means 4 apt to support at least a portion of user's body and maintain the supported portion spaced from the inner surface of the bottom wall 22. The user supported partially or totally by said supporting means 4 experiments the sensation to be partially or totally suspended in water, without the exercise of any effort to maintain such floating condition. To provide the desired effect, such supporting means 4 are configured to realize a continuous or a discontinuous supporting surface for the user.

Supporting means 4 preferably comprises a plurality of supporting elements 41, made for example of material with a specific weight lower than the specific weight of water or an another floating fluid, as to give the user the feeling that supporting means 4 pushes him in a direction opposite to the inner surface of the bottom wall 22 and has an active action in keep the user's body floating. Preferably, such material is in the form of gel or other soft substance, for example foam covered with plastic wrap. Generally, is preferred the use of materials being high compatible with the user's skin.

According to a preferred embodiment of the invention, supporting means 4 comprises one or more supporting elements 41, preferably each having an elongated shape, such as cylindrical or tubular shape. In the preferred embodiment shown in the attached Figures, four tubular shaped supporting elements 41 are provided. Such supporting elements 41 can be configured to have an adjustable position independently from each other.

Supporting means 4 is engaged or configured to engage with guide means 3, preferably by means of a reversible connection. More preferably, the arrangement of the supporting means 4 is adjustable with respect to said guide means 3, thus resulting in being adjustable with respect to the main body 2 of the bathtub 1. This allows to adjust/select the position of supporting means 4 according to the particular anatomy of the user and the therapy, and general the exercises, to be carried out in the simulated floating condition.

Supporting means 4 can extend according to longitudinal direction L or according to transversal direction T, depending upon the overall configuration of the guide means 3 and geometry of the bathtub 1.

Preferably, guide means 3 is located at one or more of said bottom or side walls 22, 22*a*, 22*b*. According to one embodiment of the invention (not shown in the attached Figures), guide means 3 can comprise one or more uprights elements arranged along longitudinal direction L, preferably at side walls 22, having upper terminal ends configured to be engaged with or to simply accommodate supporting means 4.

According to a preferred embodiment of the invention, guide means 3 is located at side walls 22*a*, 22*b*, preferably mainly extending along longitudinal direction L. In particular, the two side walls 22*a*, 22*b* have inner surfaces provided with said guide means 3 and facing each other, more preferably side walls 22*a*, 22*b* provided with guide means 3 are specular to each other with respect to axis L of longitudinal symmetry of bathtub 1.

According to the preferred embodiment shown in Figures, guide means 3 comprises a linear groove extending from a first upper terminal portion 10 to a second upper terminal portion 20 of said side walls 22*a*, 22*b*.

In particular, the groove has a first oblique development direction, descending from said first upper terminal portion 10, and a second development direction, rising towards said second upper terminal portion 20. Furthermore, at said second upper terminal portion 20, the groove can present a horizontal portion provided in order that supporting means positioned at said horizontal portion realizes a seat for the user.

Accordingly to the above described guide means 3 configuration, supporting elements 41 could be engaged at terminal ends thereof with said guide means 3. In particular, supporting means 4 can be slidably engaged or configured to slidably engage guide means 3. In other words, the adjustment of the position of supporting elements 41 is obtained by sliding said supporting elements 41 along the guide means 3. In particular, each element 41 can be selectively brought into a desired position.

Preferably, supporting means 4 can slide within guide means 3 by providing a force overcoming the resistance generated by friction between the contact surfaces of said supporting means 4 and said guide means 3. The configuration can be such that said force can be manually exercised by the user. As an alternative, bathtub can be provided with automated actuation means of supporting means 4, controlled by an interface mask integrated on the external surface of the bathtub, or by means of a remote control.

Furthermore, the bathtub according to the present invention can comprise means 55 for providing water jets for whirlpool/hydromassage. In particular, a technical area dedicated to hosting technical means 55 necessary for implementing hydromassage function, such as a compressor kit and filters, can be located at a lower portion of the bathtub denoted by 50 in FIG. 2. By virtue of said last configuration, by the floating position the user can turn on the hydromassage function, if wishes so.

Examples of different arrangements with respect to the bathtub of the supporting means in the form of tubular elements are shown in FIGS. 2, 4, 5 and 6, as better described below.

Figure 2:
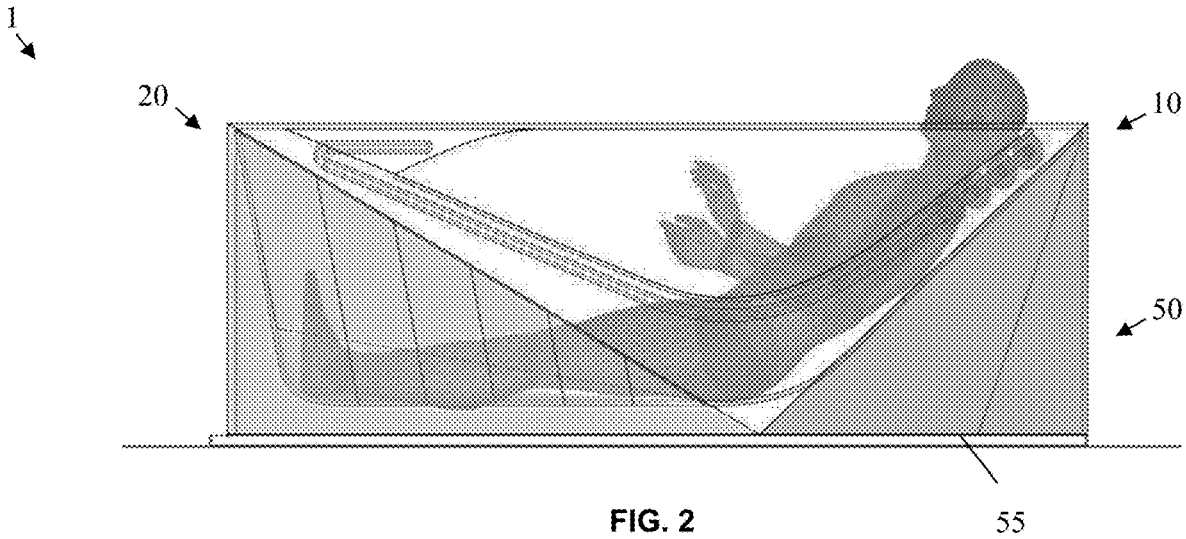

FIG. 2 shows supporting elements arranged adjacent each other at the first upper terminal portion 10, in a configuration apt to support the head of a user.

Figure 4:
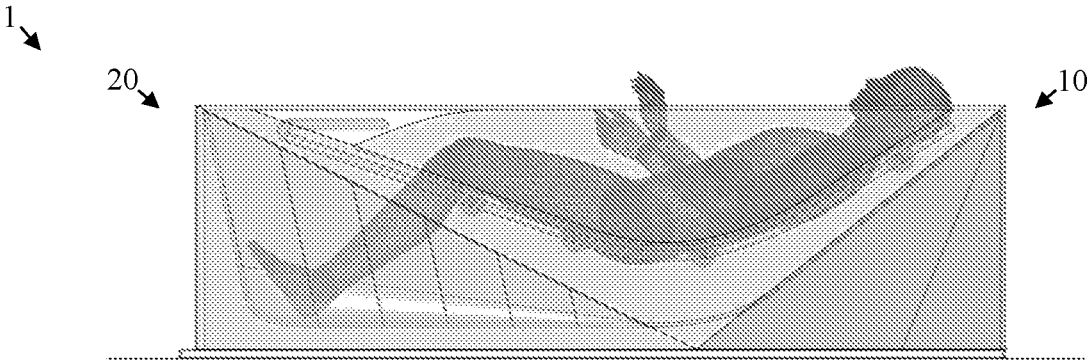

FIG. 4 shows supporting elements spaced relative to one another to realize a first floating simulation configuration, the lower parts of the legs, in particular the calves, being not supported to have the soles of the feet facing towards nozzles at upper surface of the bottom wall in order to enjoy feet soles hydromassage.

Figure 5:
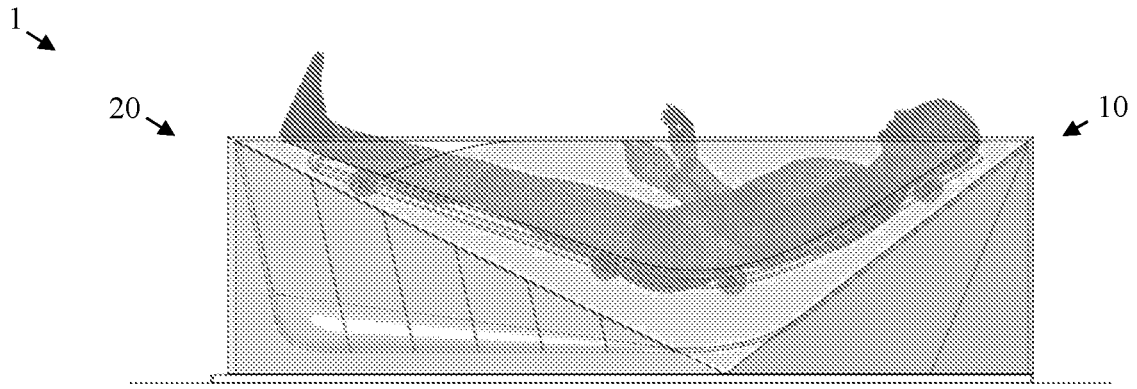
FIG. 5 shows a partially-transparent side view of the bathtub according to the embodiment of FIG. 1, in a second floating simulation configuration.

FIG. 5 shows supporting elements spaced relative to one another to realize a second configuration of floating simulation of the all user's body, to have complete hydromassage.

Figure 6:
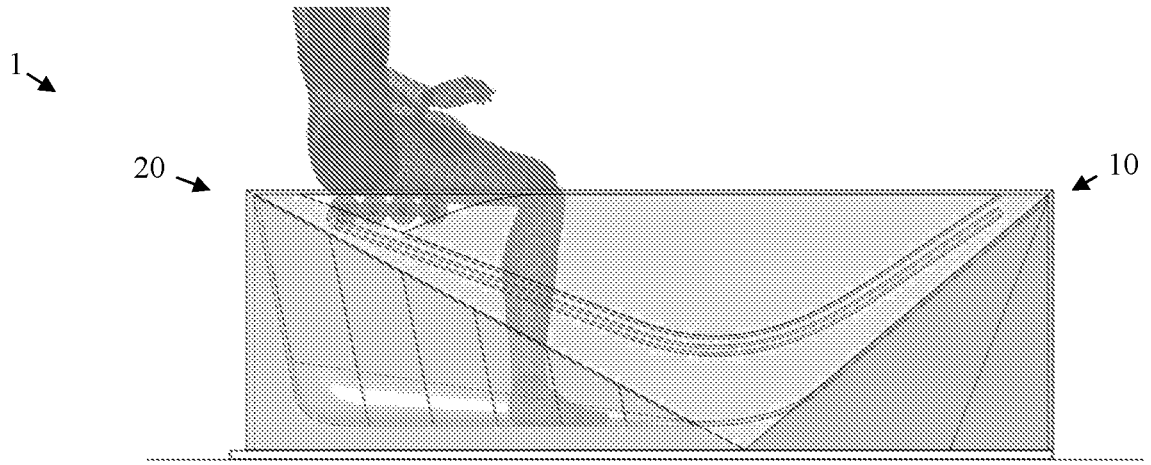
FIG. 6 shows a partially-transparent side view of the bathtub according to the embodiment of FIG. 1, wherein supporting means are arranged in a seat configuration.

FIG. 6 shows supporting elements arranged adjacent each other at the second upper terminal portion 20, to realize a seat configuration or a footbath configuration in order the user to enjoy feet soles hydromassage.

The present invention has been described so far with reference to preferred embodiments, which are intended to be combined if compatible. It is intended that there may be other embodiments which refer to the same inventive concept and fall within the scope of the appended claims.

The invention claimed is:

1. A bathtub comprising:

a main body configured to contain a floating fluid and to accommodate a user's body, which main body extends according to a longitudinal direction (L) and to a transversal direction, said main body comprising a bottom wall and side walls;

guide devices located at one or more of said bottom or side walls; and supporting devices, engaged or adapted to engage with said guide devices and configured for supporting the user's body at one or more discrete locations, so as to allow simulating, in use, a floating condition of such body, wherein said supporting devices are made of material with a specific weight lower than the specific weight of water.

2. The bathtub according to claim 1, wherein said supporting devices comprises a plurality of supporting elements.

3. The bathtub according to claim 2, wherein said supporting elements are engaged at terminal ends thereof with said guide devices.

4. The bathtub according to claim 1, wherein said supporting devices comprise one or more supporting elements each having an elongated shape, preferably a cylindrical or tubular shape.

5. The bathtub according to claim 1, wherein said supporting devices extend according to said longitudinal direction or according to said transversal direction.

6. The bathtub according to claim 1, wherein said supporting devices have an adjustable position relative to said main body.

7. The bathtub according to claim 6, wherein said supporting devices comprise a plurality of supporting elements, being of adjustable position independently from each other.

8. The bathtub according to claim 1, wherein said supporting devices are slidably engaged or adapted to slidably engage said guide devices.

9. The bathtub according to claim 1, wherein said guide devices is are located at said side walls.

10. The bathtub according to claim 1, wherein said guide devices mainly extend along said longitudinal direction.

11. The bathtub according to claim 1, wherein two of said side walls have inner surfaces provided with said guide devices and facing each other.

12. The bathtub according to claim 11, wherein said side walls provided with said guide devices are specular to each other with respect to an axis of longitudinal symmetry of said bathtub.

13. The bathtub according to claim 1, wherein said guide devices comprise a linear groove extending from a first upper terminal portion to a second upper terminal portion of said side wall.

14. The bathtub according to claim 13, wherein said linear groove has a first oblique development direction, descending from said first upper terminal portion, and a second development direction, rising towards said second upper terminal portion.

15. The bathtub according to claim 1, wherein said supporting devices are configured to slide within said guide devices by providing a force overcoming the resistance generated by friction between contact surfaces of said supporting devices and said guide devices.

16. The bathtub according to claim 1, wherein said bottom wall has an upper surface developing according to a substantially "U" shape, with longitudinal end portions being raised with respect to an intermediate portion.

17. The bathtub according to claim 1, wherein at least one of said side walls is transparent.

18. The bathtub according to claim 1, comprising devices for providing water jets for hydromassage.

* * * * *